US006597291B2

(12) United States Patent
Tsui

(10) Patent No.: US 6,597,291 B2
(45) Date of Patent: Jul. 22, 2003

(54) GARAGE DOOR MONITORING SYSTEM

(76) Inventor: Gallen Ka Leung Tsui, 2203-35 Kingsbridge Garden Circle, Skymark West 1, Mississauga, Ontario (CA), L5R 3Z5

( * ) Notice: Subject to any disclaimer, the term of this patent is extended or adjusted under 35 U.S.C. 154(b) by 0 days.

(21) Appl. No.: 09/975,280

(22) Filed: Oct. 10, 2001

(65) Prior Publication Data

US 2003/0067394 A1 Apr. 10, 2003

(51) Int. Cl.[7] ..... G08B 21/00

(52) U.S. Cl. ..... 340/686.1; 340/545.1; 340/5.7; 340/5.71

(58) Field of Search ..... 340/686.1, 545.1, 340/825.49, 815.45, 5.7, 5.71; 49/14; 200/51 R, 51.12, 61.74, 61.76, 61.78, 530, 538

(56) References Cited

U.S. PATENT DOCUMENTS 4,583,081 A * 4/1986 Schmitz ..... 340/545
4,954,810 A * 9/1990 Llewellyn ..... 340/545
5,596,840 A * 1/1997 Teich ..... 49/26
5,689,236 A * 11/1997 Kister ..... 340/545
5,798,681 A * 8/1998 Chang ..... 340/815.45
5,883,579 A * 3/1999 Schreiner et al. ..... 340/686.1
6,049,285 A * 4/2000 Mangal et al. ..... 340/686.1
6,070,361 A * 6/2000 Paterno ..... 49/14
6,107,765 A * 8/2000 Fitzgibbon et al. ..... 318/266
6,111,374 A * 8/2000 Fitzgibbon et al. ..... 318/282
6,166,634 A * 12/2000 Dean ..... 340/545.1
6,346,889 B1 * 2/2002 Moss ..... 340/686.1

* cited by examiner

*Primary Examiner*—Toan Pham

(57) ABSTRACT

A system and method for monitoring a garage door position from a remote location. A local sensor detects the position of a garage door and provides this information to a local transmitter. The transmitter is capable of generating a signal indicating the garage door position, where the signal can be detected by a remote receiver. In one embodiment, infrared sensors are used to detect the garage door position, while in another embodiment trigger switches detect the direction in which the garage door is moving.

39 Claims, 13 Drawing Sheets

GARAGE DOOR MONITORING SYSTEM

BACKGROUND OF THE INVENTION

1. Field of the Invention

The invention relates generally to remote monitoring systems, and specifically to a panel monitoring system that provides panel position information to a remote location.

2. Background of the Invention

Garage doors of the prior art have heretofore not been commercially supplied with a means to remotely detect whether the garage door is open or closed. At the same time, the role of the garage has been ever expanding, thereby making it more desirable to have a means to detect the status of the garage door from a remote location. For example, in addition to being an area in which to park one's car, many people use their garage as an additional work area. Many people also use the garage entrance to the house as their primary entrance/exit point. As the functions of the garage have changed, the uncertainty in predicting the position of the garage door at any given time has increased. It is no longer a common practice to open the garage door as one pulls into their driveway and close it behind them once they have driven into the garage. That being the case, it has become desirable to provide a means to ascertain whether the garage door is in the open or closed position from a remote location, such as from within the home.

Given that garage doors are not commercially supplied with a means to detect the garage door position, efforts have been made in the prior art to accommodate this desire. However, such efforts have relied on adding complicated additional hardware to the garage door system.

Accordingly, there is a need in the art for an improved garage door monitoring system that is capable of providing garage door position information to a remote location, without the need for excessive additional hardware.

BRIEF SUMMARY OF THE INVENTION

The invention provides a system and method for monitoring a position of a panel. The method comprises sending a sensor signal to a transmitter where the sensor signal is provided by a sensor detecting a status of the panel, receiving said sensor signal by the transmitter, sending a position signal from said transmitter to a remote receiver, said position signal corresponding to the status of the panel, and providing a position indicator from said remote receiver corresponding to said status of the panel. In one embodiment, the sensor signal is provided by an infrared emitter operating with an infrared receiver, said infrared emitter and infrared receiver to detect a status of the panel.

Other embodiments are disclosed and claimed herein.

DETAILED DESCRIPTION OF EXAMPLARY EMBODIMENTS

The invention provides a panel monitoring system whereby the position of the panel can be ascertained from a remote location. While the following description describes the monitoring system in terms of garage doors and garage door position monitoring, it is to be understood that the following disclosure may also be applied to position monitoring of other types of panels as well.

In one embodiment, a transmitter is attached to a sensor, where the transmitter and sensor are both local to the garage door. In this embodiment, the transmitter supplies a signal to a remote receiver corresponding to the sensor's input to the transmitter. The receiver may then be connected to an indicator that identifies the position of the garage door. While in one embodiment the indicator may be an indicator light, in another embodiment the indicator emits an audible signal corresponding to the garage door position.

In one embodiment, the limit switches of the garage door are used to provide the sensor input to the transmitter. In another embodiment, the infrared sensors of the garage door provide an input to the transmitter indicating the current position of the door. Some of the possible configurations of the infrared sensors are discussed in more detail below.

Yet another embodiment of the invention uses trip switches to detect the direction of movement of a trolley assembly attached to the garage door. This embodiment can be used to detect the general position of the door, as well as the direction in which the garage door is moving.

Another embodiment of the invention relies on detecting the physical position of the door itself. In particular, a sensor emitter/receiver may be attached to the door opener mechanism and pointed in the direction of the garage door, while a reflector is attached to the door itself. In this manner, the sensor emitter/receiver will provide one signal to the transmitter when the door is in a first position, while providing a different signal when the door is in a second position. In another embodiment, the physical position of the garage door may be detected where the sensor is a button switch mounted near the bottom of the door, or a magnetic switch attached between the garage door and door frame. These and other embodiments that detect the physical position of the door are described in more detail below.

Yet another embodiment of the invention monitors the movement of the linkage between the garage door motor and the door itself. Finally, it is also possible to monitor the garage door motor by integrating an infrared interrupter into the garage door opening mechanism, according to another embodiment.

Figure 1:
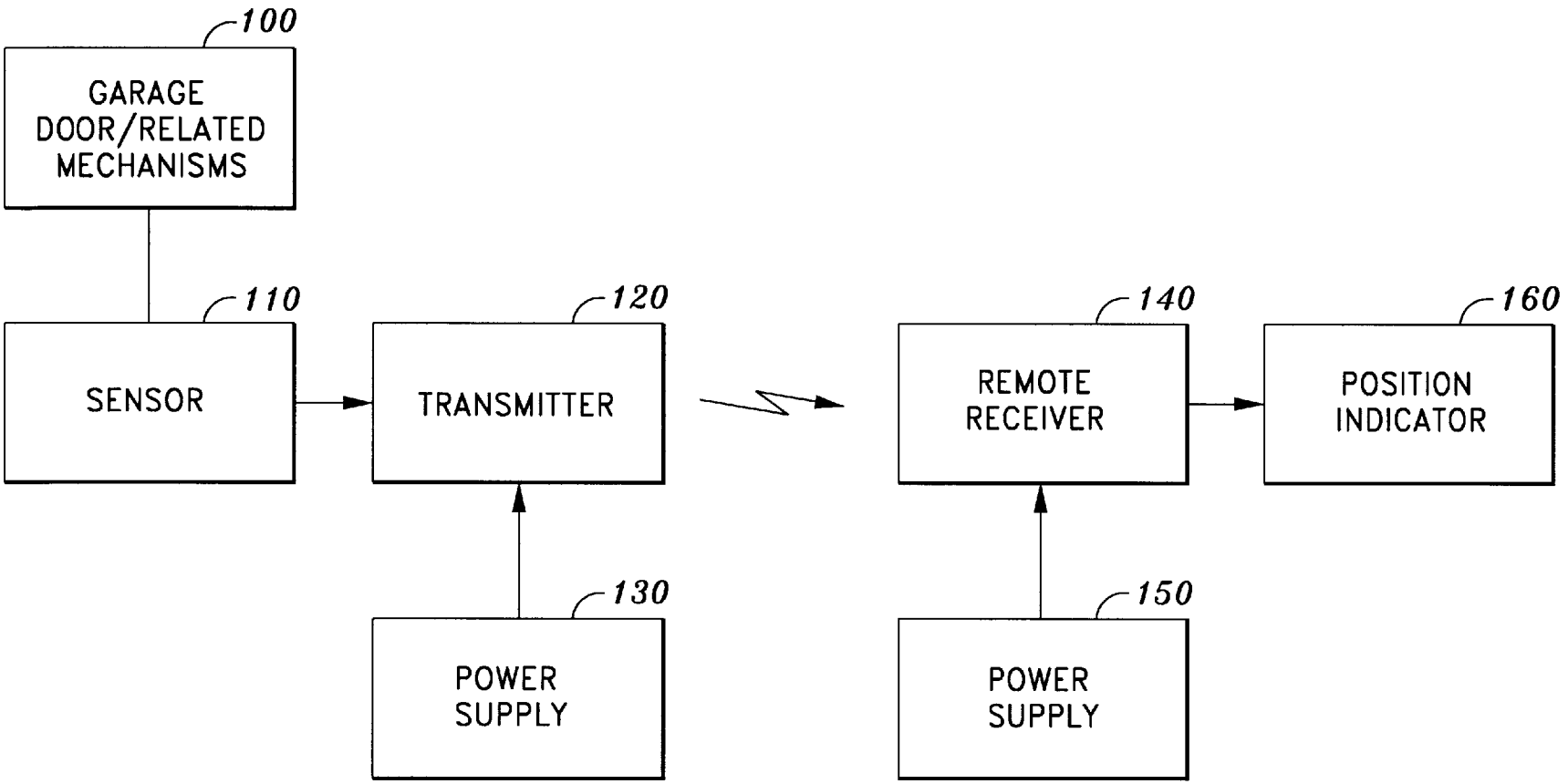
FIG. 1 illustrates a block diagram of a garage door monitoring system, consistent with the invention.

Referring now to the drawings, and in particular to FIG. 1, there is shown a block diagram of a garage door monitoring system. In FIG. 1, the sensor 110 detects a position of the garage door/related mechanisms 100. As will be discussed in more detail below, the sensor 110 may detect the position and/or direction of motion of the garage door or mechanisms associated therewith. The sensor 110 may then provides a signal to the transmitter 120 corresponding to a state of the garage door/related mechanisms 100, according to one embodiment. Power supply 130 may be connected to the transmitter 120, or may alternatively be included within the transmitter 120, such as when power supply 130 is a DC source. Alternatively, power supply 130 may be an AC source.

Continuing to refer to FIG. 1, transmitter 120 processes the signal from sensor 110 and provides a corresponding signal which is to be received by remote receiver 140, according to one embodiment. While the signal provided by the transmitter 120 may be a radio frequency (RF) signal, it should be appreciated that other types of signals known in art may also be used. Power supply 150 is connected to remote receiver 140 and may provide an AC or a DC current, according to one embodiment.

Once remote receiver 140 receives a position signal from transmitter 120, it may then direct position indicator 160 accordingly. In one embodiment, position indicator 160 is comprised of one or more visual indicators, such as light emitting diodes (LED). In another embodiment, position indicator 160 is comprised of an audio indicator, which may be a buzzer emitting an audible signal indicating the garage door position. In yet another embodiment, position indicator 160 comprises a power relay which enables power to a device indicating the garage door position. By way of a non-limiting example, this power relay may enable power to a radio, light, television, or any other device which operates on an AC current. It should be appreciated that other embodiments of the position indicator 160 are possible.

Figure 2:
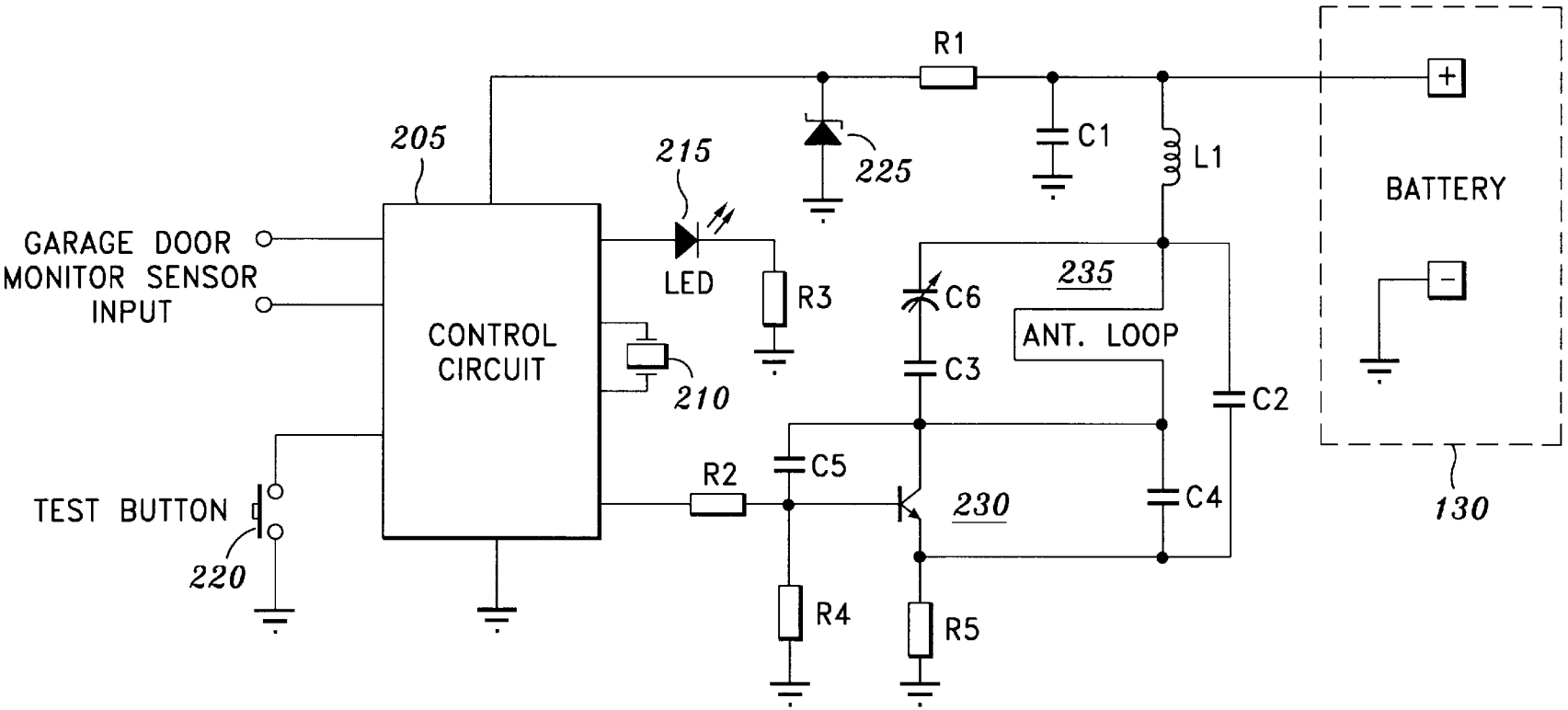
FIG. 2 is a schematic diagram of a transmitter, according to one embodiment of the invention.

Referring now to FIG. 2, in which a schematic of one embodiment of the transmitter 120 is depicted. In this embodiment, sensor input is supplied to the Control Circuit 205, which may be a central processing unit, microprocessor, processor, a microcontroller, or any like control circuit/device. In the embodiment of FIG. 2, oscillator 210 is attached to Control Circuit 205. Similarly, LED 215 may be used to indicate when there is signal transmission, while test button 220 may be used to test communication between the transmitter 120 and remote receiver 140. Note that in this embodiment, power supply 130 is a DC power source. Voltage regulator 225 is used to maintain the voltage to Control Circuit 205. In one embodiment, voltage regulator 225 is a Zenar diode which maintains a voltage of 5 volts to the Control Circuit 205, although other voltages may be used. Based on the input from sensor 110, Control Circuit 205 directs switch 230. In turn, antenna 235 may produce an RF signal having a frequency recognizable by remote receiver 140, where the signal frequency of antenna 235 depends on the state of switch 230, as well as capacitors C2–C6.

Figure 3A:
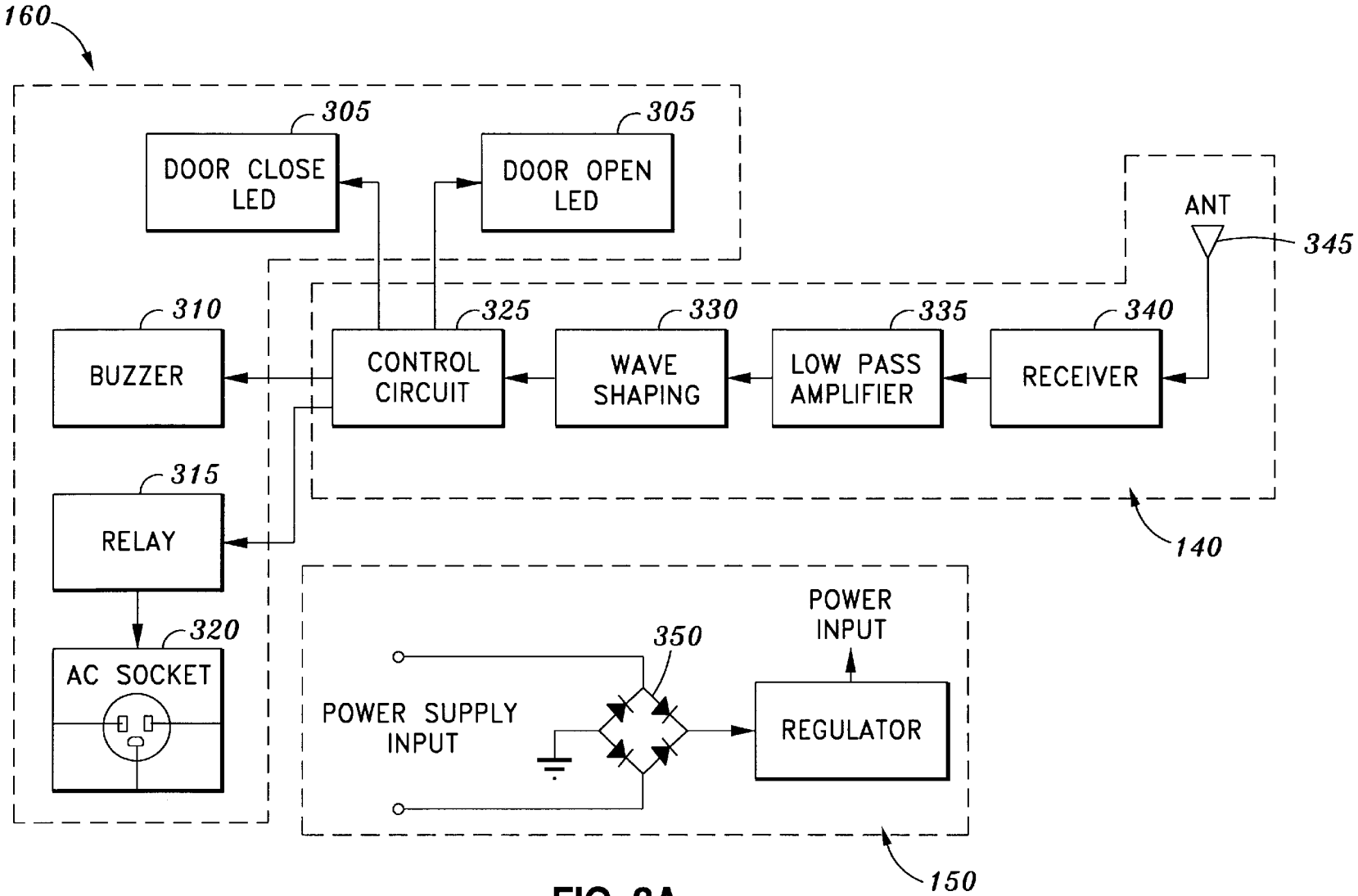
FIG. 3A illustrates a block diagram of a remote receiver, according to one embodiment of the invention.

Referring now to FIG. 3A, depicted is a block diagram for the remote receiver 140, power supply 150, and position indicator 160 of FIG. 1, according to one embodiment. In this embodiment, remote receiver 140 includes Control Circuit 325, wave shaping circuit 330, low pass amplifier 335, receiver circuit 340, and antenna 345. After antenna 345 receives the signal from transmitter 120, receiver circuit 340 may process the signal. In one embodiment, receiver circuit 340 is a regenerative circuit which performs equalization, timing and decision-making processes on the received signal so as to minimize the effects of amplitude and phase distortions on the received signal, which in one embodiment is an RF signal. Thereafter, low pass amplifier 335 and wave shaping circuit 330 further condition the signal before it is provided to Control Circuit 325.

A more detailed embodiment of power supply 150 is also depicted in FIG. 3A. In this embodiment, the input power supply is passed through a rectifying bridge 350 and then through a voltage regulator 355. In one embodiment, the power supply is a DC source, while in another embodiment it is an AC source. In yet another embodiment, the voltage regulator 355 regulates the voltage to 5 volts, although other voltage levels may be used.

One embodiment of the position indicator 160 of FIG. 1 is also depicted in FIG. 3A. In this embodiment, position indicator 160 includes a pair of LED indicators 305 corresponding to the open and closed positions of the garage door. In addition, buzzer 310 may be used to indicate a particular state of the garage door, such as an open state or that the garage door is in motion. In addition, this embodiment of position indicator 160 includes AC socket 320 connected to a relay 315. The AC socket 320 can be used to provide power to any device capable of serving as a position indicator upon being provided with the appropriate signal from relay 315. Such a device may be a light, radio, television, or any other device which operates on AC current.

Figure 3B:
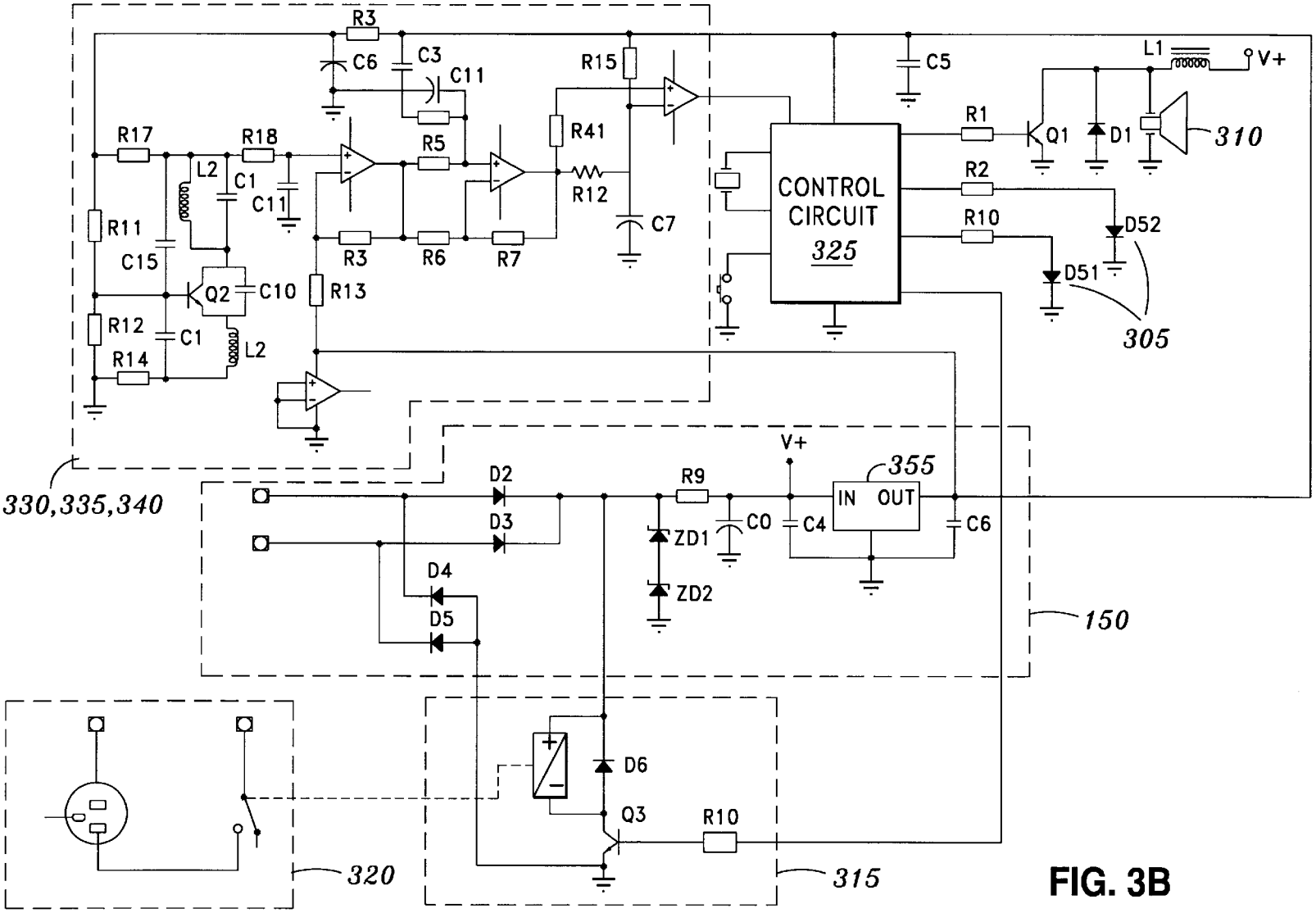
FIG. 3B is a detailed schematic of the remote receiver of FIG. 3A.

FIG. 3B is a more detailed schematic of the circuits of FIG. 3A. In particular, power supply 150 includes diodes D2–D5, which correspond to rectifying bridge 350. Zenar diodes ZD1 and ZD2 are used for voltage regulation, along with voltage regulator 355. As is also shown FIG. 3B, AC socket 320 is connected to relay 315, which is in turn connected to Control Circuit 325. As with FIG. 3A, the remote receiver 140 of FIG. 3B includes buzzer 310 and LEDs 305 serving the role of position indicator 160. Finally, wave shaping circuit 330, low pass amplifier 335 and receiver 340 (330/335/340) are shown connected to the Control Circuit 325 and power supply 150.

Figure 4A:
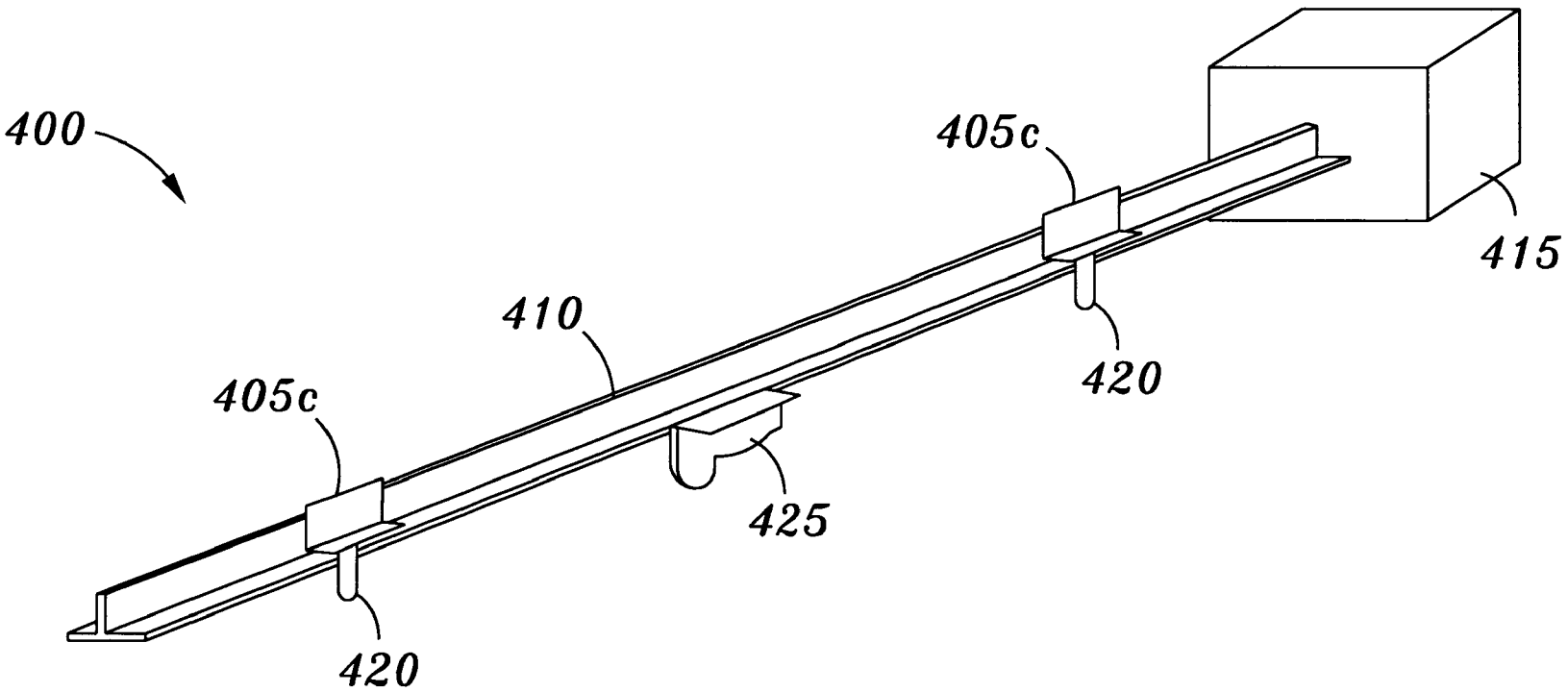
FIG. 4A depicts the orientation of limit switches situated along a garage door opening system, according to one embodiment.

As mentioned above, one embodiment seeks to utilize the limit switches of a garage door opening system as the sensor inputs for the transmitter 120. To this end, FIG. 4A illustrates one embodiment of a garage door opening system 400 having limit switches 405*o* and 405*c* situated along a center rail 410 that is attached to a motor 415. As motor 415 drives the garage door (not shown) up and down the center rail 410, limit switches 405*o* and 405*c* are contacted by the garage door. In one embodiment, the garage door has a trolley 425 affixed to it such that the trolley 425 contacts limit switch 405*o* when the garage door is in its fully open position. Similarly, the trolley 425 is positioned such that it contacts limit switch 405*c* when the garage door is in a fully closed position.

In one embodiment, when the trolley 425 contacts the limits switches 405, a lever 420 of the limit switches 405 is caused to close an otherwise open circuit thereby supplying a signal. Thus, by connecting transmitter 120 to the limit switches 405 it is possible to provide a signal to the remote receiver 140 corresponding to the garage door position. For example, when the garage door is in the closed position, lever 420 of limit switch 405*c* will form a closed circuit thereby indicating the closed position of the garage door. Once the garage door begins moving, limit switch 405*c* will be open. When the garage door reaches it's fully open position, limit switch 405*o will* form a closed circuit indicating the garage door is in the full upright position. However, until the garage door reaches the fully open position, both limit switches 405 are open, thereby indicating the door is either in motion or has stopped in an intermediate position. Thus, not only does this embodiment provide position information, but it also provides a means to determine whether or not the garage door is in motion. In one embodiment, buzzer 310 sounds when the garage door is not in the closed position, while one or more of the LEDs 305 illuminate when the garage door is closed or open, as appropriate.

Figure 4B:
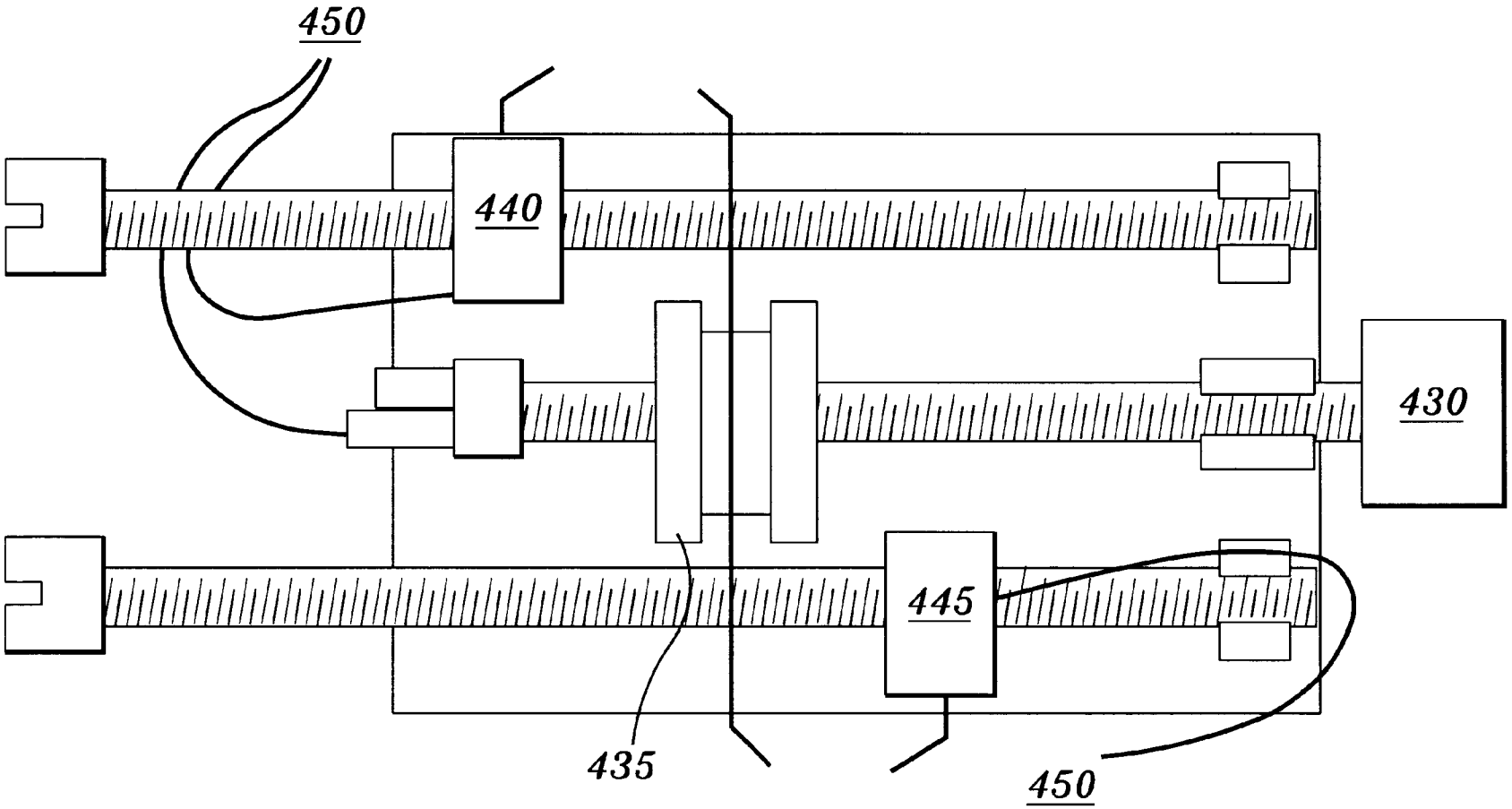
FIG. 4B is a cross section of a mechanism comprising part of a garage door opening system that is consistent with the principles of the invention.

Another embodiment utilizing a limit switch is depicted in FIG. 4B. In this embodiment, drive gear 430 is attached to the garage door motor (not shown). As the motor rotates the drive gear 430, the center limit contact 435 moves accordingly. In particular, as the garage door is opening, the center limit contact 435 will move in the direction of the up contact 440. When the center limit contact 435 reaches the up contact 440, a circuit attached by wires 450 is closed and the motor is stopped. Similarly, when the garage door is closing the center limit contact moves in the direction of the down contact 445, until a circuit with the down contact 445 is closed. In one embodiment, the positions of the up contact 440 and down contact 445 are adjustable. The limit switch of FIG. 4B can be used to generate a position signal which the transmitter 120 can then convey to the remote receiver 140. This may be done by connecting the up contact 440 and down contact using wires 450 to the transmitter 120.

In yet another embodiment, the limit switch may be an infrared photo-interrupter having an emitter and receiver. The interrupter is housed within the garage door motor and senses the number of rotations of a cup assembly which rotates as the motor drives the garage door. A predetermined number of rotations is programmed into the unit, where this number equals the number of rotations required for the door to reach its fully open position from its fully closed position; and vice versa. A local memory maintains the current number of rotations and instructs the motor to stop once this predetermined number of rotations has been reached. In this case, the transmitter 120 may be coupled to the interrupter which indicates the exact position of the door based on how many rotations have been recorded. The interrupter may also provide a signal to the transmitter indicating when the garage door is in motion. It should further be appreciated that an infrared interrupter may be used to detect motion within the motor of the garage door opener. For example, an interrupter may positioned within the motor such that movement from gears, flywheels and the like causes the interrupter to send a corresponding signal to a transmitter, which may also be housed within the motor portion of the garage door opener.

Figure 5A:
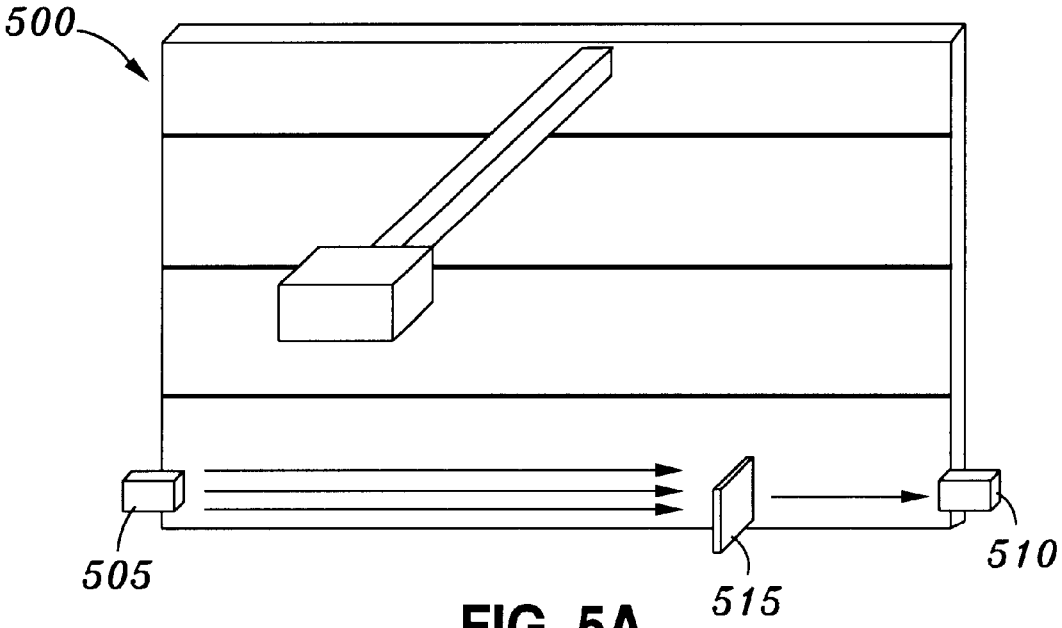
FIGS. 5A–5D depicts the orientation of infrared sensors used in accordance with the principles of the invention.

As mentioned above, another aspect of the invention seeks to use the infrared sensors of a garage door opening system to provide position information to a remote location. To this end, one aspect of the invention seeks to build on the typical garage door arrangement in which two infrared sensors are placed on either sides of the garage door near the base. Referring in particular to FIG. 5A, a garage door 500 is depicted having infrared emitter 505 and infrared receiver 510 located on either side near the base of garage door 500. While the figures depict infrared emitter 505 on the left inside part of garage door 500 and infrared receiver 510 on the right side, it should be appreciated that other arrangements are possible. For example, infrared emitter 505 may be on the left inside portion of garage door 500, with infrared receiver 510 on the left side. In another embodiment, infrared emitter 505 and infrared receiver 510 may be situated on the outside part of the garage door.

Figure 5B:
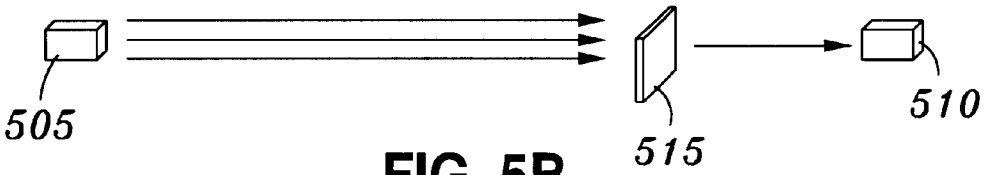
Figure 5C:
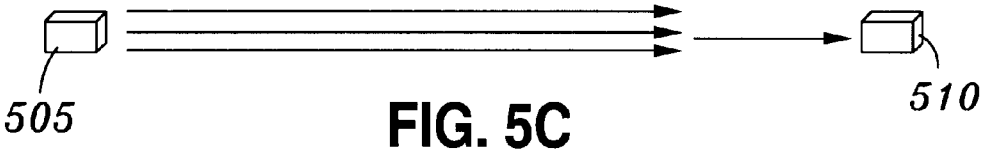
Figure 5D:
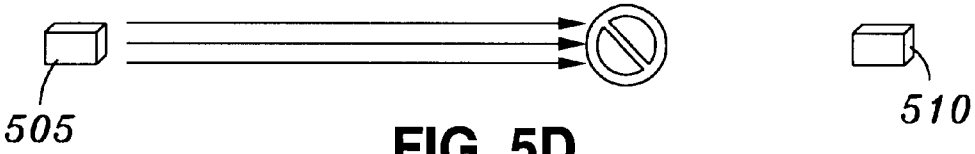

In the typical garage door system, the garage door 500 will stop closing if the infrared signal between the emitter 505 and receiver 510 is blocked. In the embodiment depicted in FIG. 5A, an opaque element 515 is placed such that it is situated between the emitter 505 and receiver 510 when the garage door 500 is in the fully closed position. In the embodiment o FIG. 5A, the opaque element 515 is designed such that some fraction of the infrared signal is able to pass through it, as shown in FIG. 5B. In turn, transmitter 120 (not shown) is connected to the infrared receiver 510, according to one embodiment. In this fashion, transmitter 120 connected to infrared receiver 510 can detect and report to remote receiver 140 on the different states of the garage door 500. As depicted in FIG. 5B, the first state occurs when the garage door 500 is fully closed and infrared receiver 510 detects a partially-block infrared signal. In this state, transmitter 120 would send a signal to remote receiver 140 indicating that the door is fully closed. FIG. 5C depicts the second possible state in which infrared receiver 510 detects receiving a full-strength signal from infrared emitter 505. In this state, transmitter 120 would provide a signal to remote receiver 140 indicating that the garage door 500 is not fully closed. Finally, FIG. 5D illustrates the third state in which an obstruction is present.

Figure 6A:
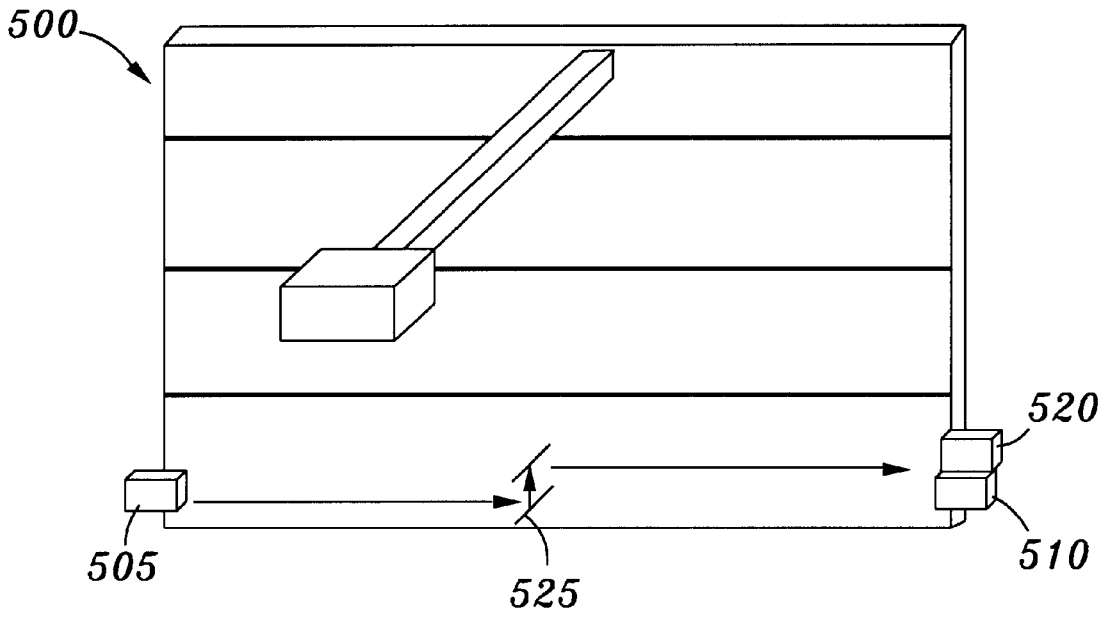
FIGS. 6A–6C illustrate another embodiment of the invention using infrared sensors.

FIG. 6A depicts another embodiment of the invention which also utilizes the infrared sensors of a garage door opening system. In this embodiment, an additional infrared receiver 520 is situated near the original infrared receiver 510. A reflective element 525 is situated between infrared emitter 505 and infrared receivers 510 and 520 and may be attached to the garage door 500, as shown in FIG. 6A. In one embodiment, reflective element 525 is comprised of two surfaces, each capable of reflecting infrared light and arranged in parallel to one another, as shown in FIG. 6A. It should be appreciated that other arrangements and embodiments of reflective element 525 consistent with the invention are possible.

Figure 6B:
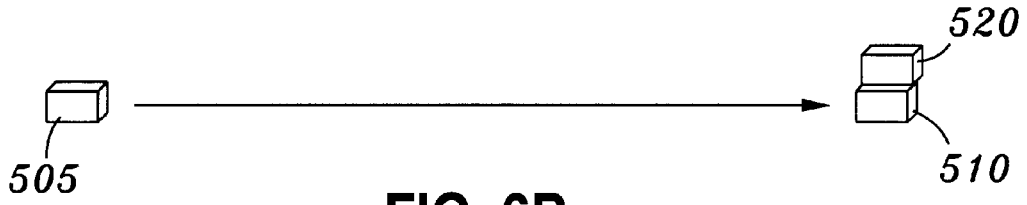
Figure 6C:
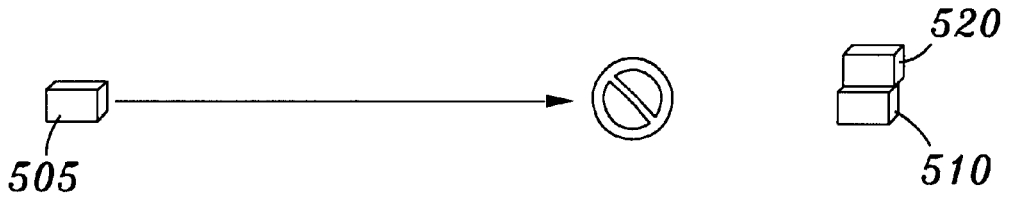

As with the embodiment of FIGS. 5A–5D, the embodiment of FIGS. 6A–6C is capable of detecting various garage door 500 states. Namely, when the garage door 500 is in the fully closed position, as in FIG. 6A, reflective element 525 directs the infrared signal to infrared receiver 520. When the garage door 500 is not fully closed, the infrared signal is not intercepted by reflective element 525 and passes directly to infrared receiver 510, as shown in FIG. 6B. In one embodiment, transmitter 120 is connected to both infrared receivers 510 and 520 so that transmitter 120 can provide a signal to remote receiver 140 indicating whether the garage door 500 is fully closed or not. Finally, an obstruction in the garage door 500 entrance, as shown in FIG. 6C, can be detected since the infrared signal of emitter 505 will not be detected by either infrared receiver 510 and 520.

Figure 7:
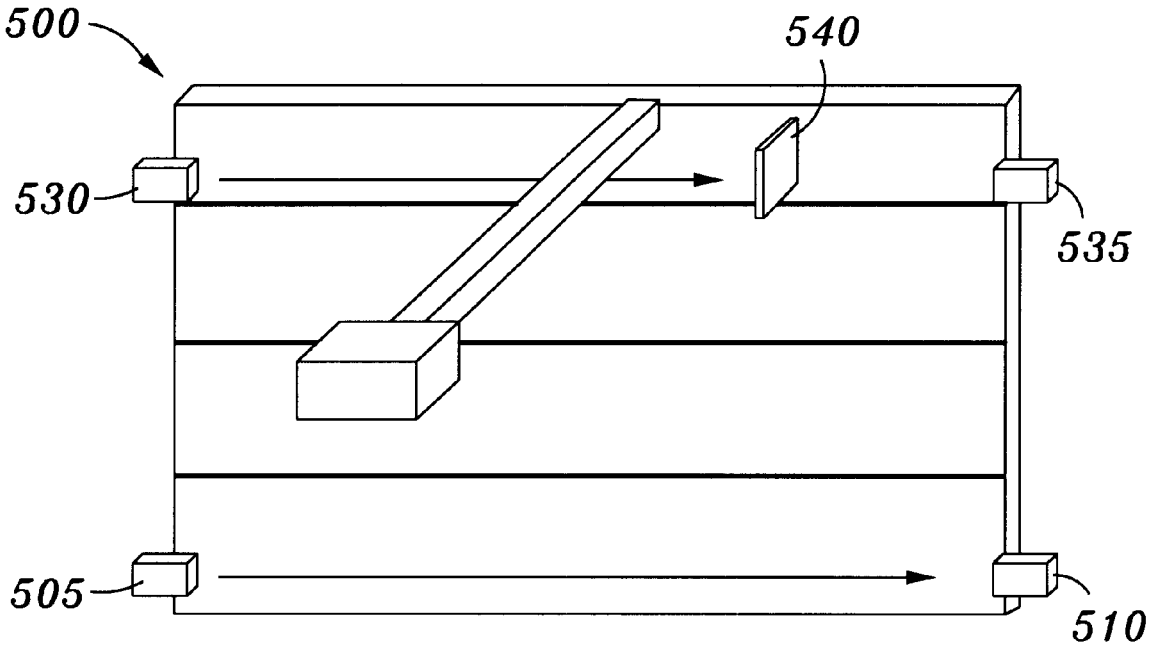
FIG. 7 illustrates yet another embodiment of the invention using infrared sensors.

Yet another embodiment of the invention is depicted in FIG. 7. In this embodiment, a second infrared emitter 530 and infrared receiver 535 are situated across the garage door 500. While in the embodiment of FIG. 7 emitter 530 and receiver 535 are situated near the top of the garage door 500, it should be appreciated that any number of other locations may be selected. Regardless of the orientation selected, reflective element 540 may be attached to the garage door 500 in an orientation which allows it to reflect the infrared signal provided by emitter 530, as shown in FIG. 7. In this embodiment, the infrared receiver 535 will not receive any infrared signal when the door is in the fully closed position. Transmitter 120 connected to receiver 535 may then process this information and provide a signal to remote receiver 140 indicating that the garage door 500 is open. Similarly, when the garage door is not fully closed, infrared receiver 535 will receive the infrared signal provided by infrared emitter 530, thereby enabling the connect transmitter 120 to provide a signal to remote receiver 140 that the garage door 500 is at least partially open. In this embodiment, infrared emitter 505 and receiver 510 may be used to detect obstructions in the garage door's path.

Figure 8A:
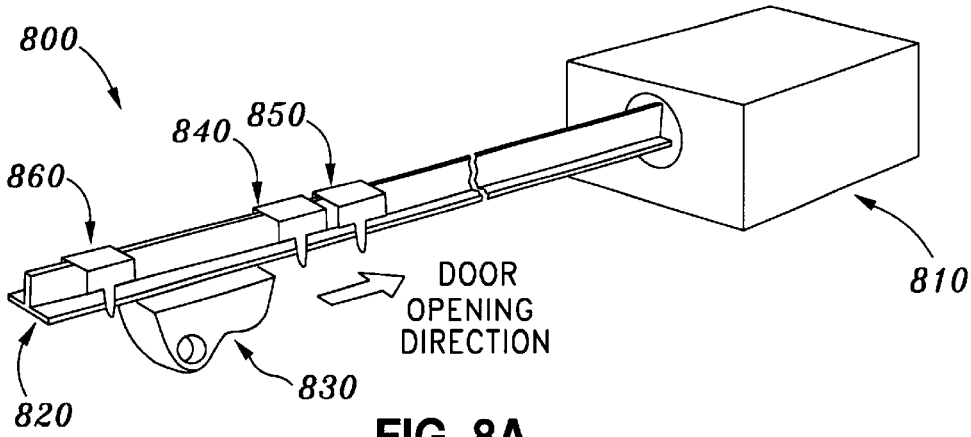
FIGS. 8A–8B illustrate a garage door opening mechanism, according to one embodiment.
Figure 8B:
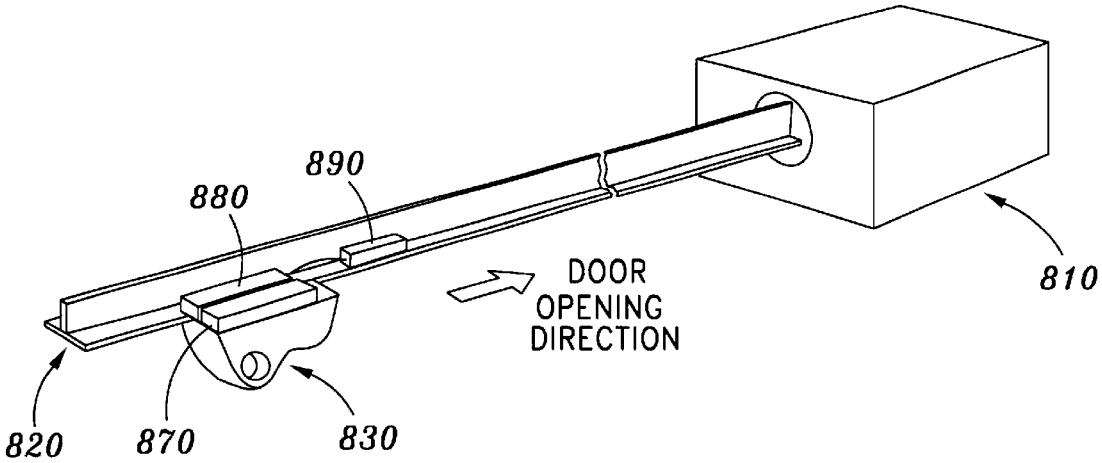

FIGS. 8A–8B illustrate yet another embodiment of the invention. Referring first to FIG. 8A, depicted is a garage door opening system 800 which utilizes a trolley assembly. In this embodiment, a motor 810 is attached to a rail 820, along which a trolley assembly 830 travels. As the attached garage door is opening, trolley assembly 830 moves in the direction of the motor 810 along the rail 830. Similarly, as the door is closing, trolley assembly 830 moves along the rail 820 away from motor 810.

Still referring to FIG. 8A, trip switches 840 and 850 have been attached to rail 820. Trip switches 840 and 850 are situated such that trolley assembly 830 will come into physical contact with them as the garage door is moving and the trolley assembly 830 passes by that part of the rail 820. Arranged as such, trip switches 840 and 850 can be used to detect the direction the garage door is moving. In particular, if the trolley assembly 830 activates trip switch 840 and then switch 850, the attached garage door must be opening. However, if switch 850 is activated before switch 840, it must be the case that the garage door is closing. In one embodiment, transmitter 120 may be connected to trip switches 840 and 850 so that the direction of movement of the garage door can be transmitted to remote receiver 140.

It should be appreciated that while the trolley assembly 830 is typically attached near the top of the garage door, it may be attached along other points on the garage door.

In another embodiment, trip switches 840 and 850 can be accompanied with limit switches, such as limit switch 860, such that both the position of the door as well as the direction of motion can be detected and provided to remote receiver 140.

In another embodiment of the garage door opening system 800 of FIG. 8A, a pair of infrared interrupters (not shown) may be positioned along the rail 820 such that the sequence in which the interrupters are triggered by the trolley assembly 830 would correspond to the direction the garage door is moving.

FIG. 8B depicts another embodiment of the invention in which a magnet 870 is attached to the trolley assembly 830 and a magnetic reed switch 880 is attached to the rail 820. In one embodiment, the reed switch 880 is placed at the position on the rail 820 which corresponds to the trolley assembly's 830 position when the garage door is in the fully closed position. By attaching the transmitter 890 to the reed switch 880, a signal indicating the position of the garage door may be generated. In one embodiment, transmitter 890 is transmitter 120 and a position signal is received by remote receiver 140.

Figure 9A:
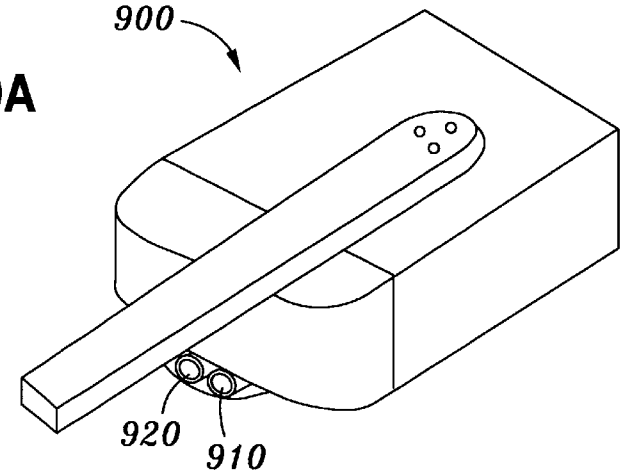
FIG. 9A depicts a garage door opening mechanism, according to another embodiment.

Referring now to FIG. 9A, in which the motor portion 900 of a garage door opening system is depicted. In this embodiment, infrared emitter 910 and infrared receiver 920 have been attached to the lower surface of the motor portion 900. While infrared emitter 910 and receiver 920 have been depicted in FIG. 9A to be enclosed side-by-side in a single casing, it should be appreciated that other configurations would also be consistent with the invention where an infrared signal is permitted to reflect off of a garage door. For example, infrared emitter 910 and receiver 920 may be enclosed within the motor portion 900 of the garage door opening system.

Figure 9B:
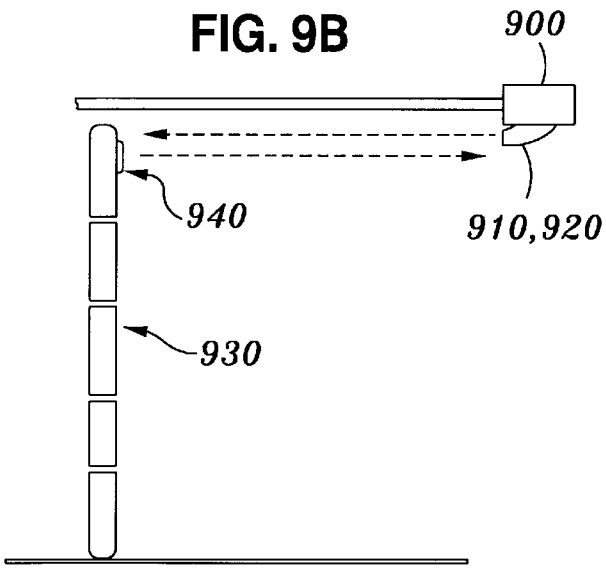
FIGS. 9B–9C illustrate the orientation of the garage door opening mechanism of FIG. 9A, according to one embodiment.
Figure 9C:
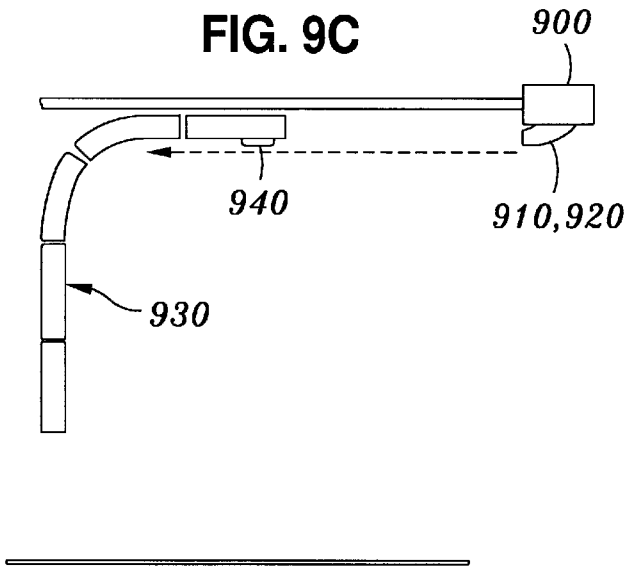

FIG. 9B illustrates how infrared emitter 910 can be used to reflect an infrared signal off of a reflective element 940 attach to garage door 930. When the garage door 930 is fully closed, reflective element 940 will reflect the infrared signal back to receiver 920. However, when garage door 930 is not fully closed, as in FIG. 9C, reflective element 940 will not be able to reflect the signal to the infrared receiver 920. In one embodiment, a transmitter, such as transmitter 120, may be connected to infrared receiver 920 allowing the position of the garage door to be detected from a remote location.

Figure 10A:
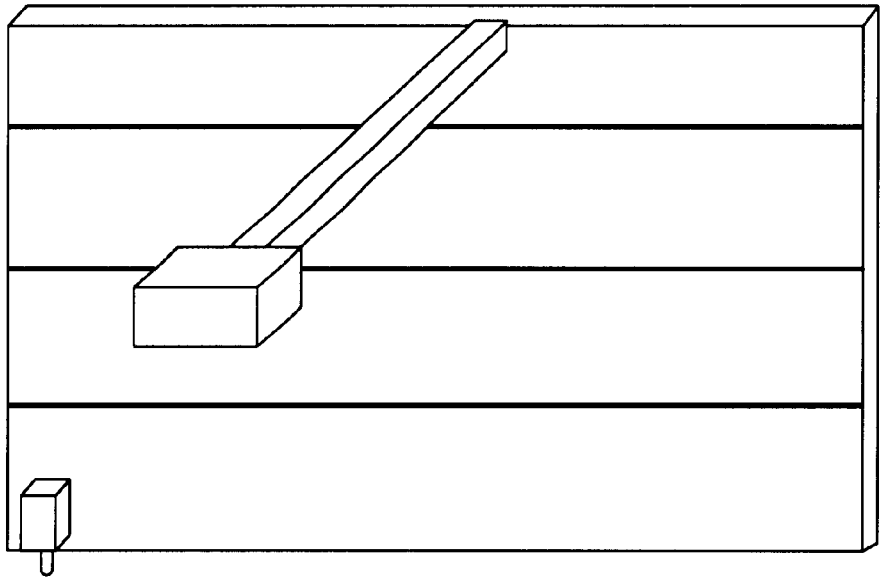
FIGS. 10A–10B illustrate yet another embodiment of the invention.
Figure 10B:
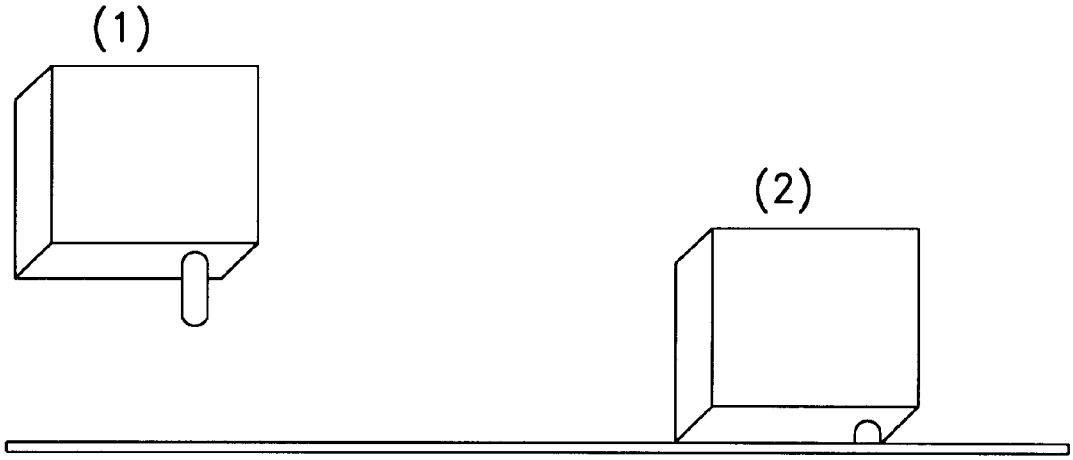

FIG. 10A illustrates yet another embodiment of the invention. In this embodiment, button mechanism 950 is attached near the bottom of garage door 960. Button mechanism 950 includes an external button which is oriented such that it is depressed when garage door 960 is in the closed position. By way of a non-limiting example, FIG. 10B(1) illustrates the button mechanism 950 when the button is not depressed, as would be the case when the garage door 960 is not fully closed, while FIG. 10B(2) illustrates the depressed state of the button. In this manner, button mechanism 950 may provide a signal to transmitter 120 indicating the state of the button as either state (1) or state (2). In one embodiment, transmitter 120 may be electrically connected to button mechanism 950, while in another embodiment transmitter 120 is housed within the casing for button mechanism 950.

It should further be appreciated that the button mechanism 950 may be in the form of a pressure switch attached a surface against which the garage door closes. In one embodiment, this surface is the garage floor slab against which an overhead garage closes. However, a sliding garage door may have a pressure switch on a wall against which the garage door closes. Similarly, the pressure switch may be located on any other surface which is contacted by the garage door panel when in the closed position.

Figure 11A:
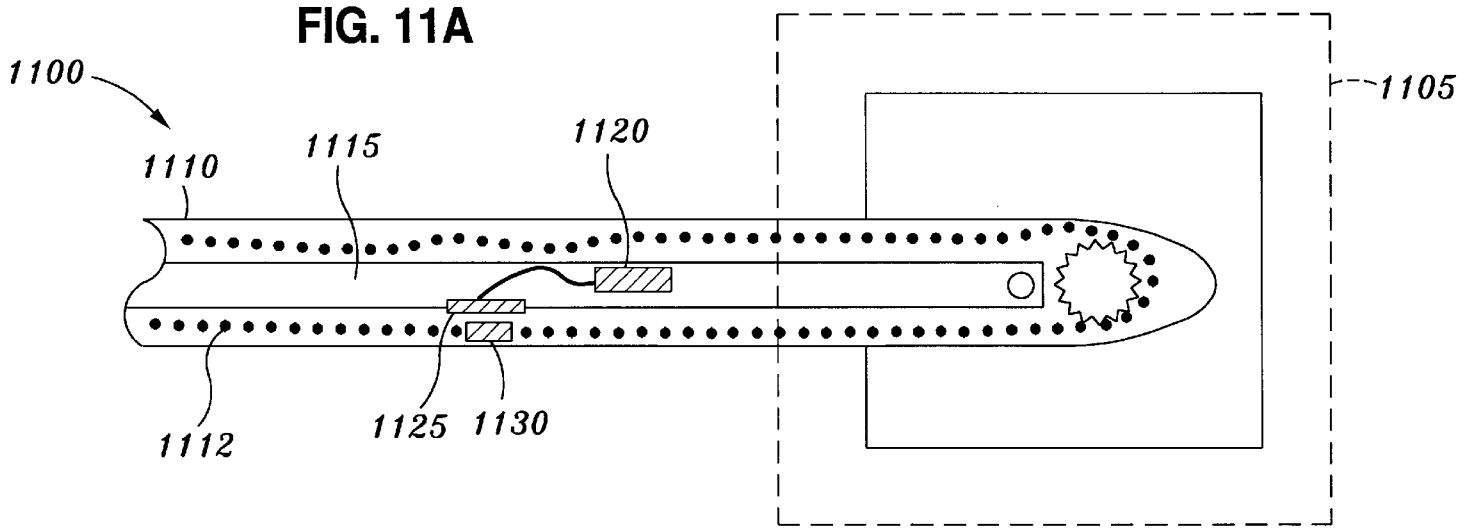
FIGS. 11A–11B illustrate a garage door opening mechanism, according to yet another embodiment of the invention.
Figure 11B:
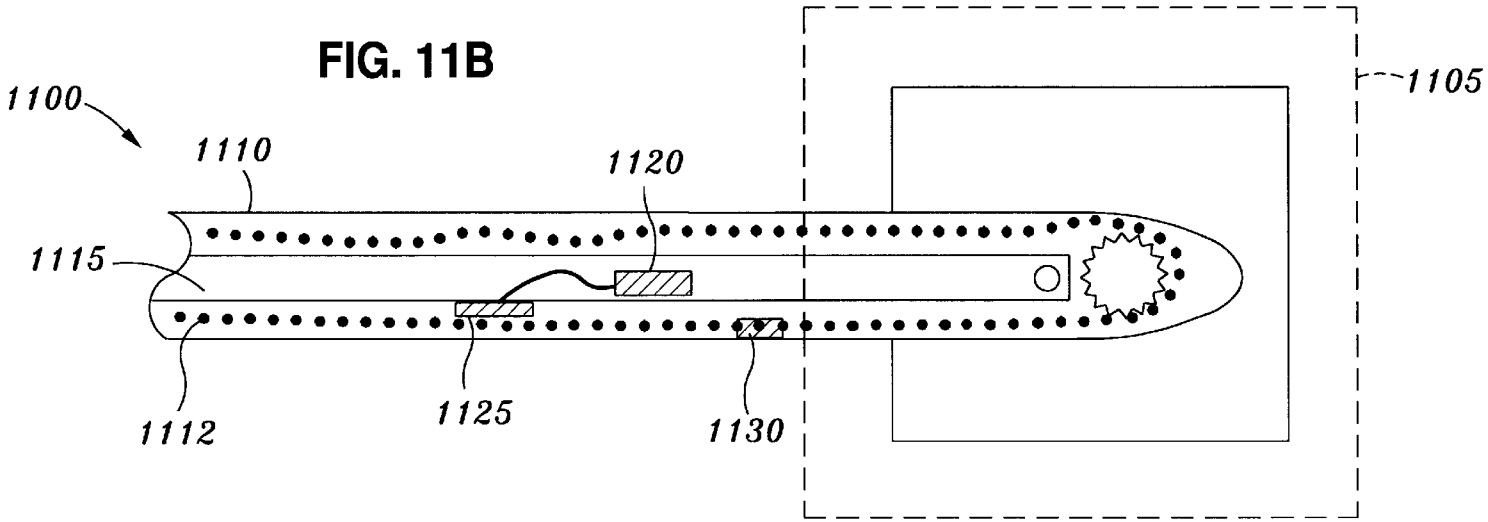

FIGS. 11A and 11B depict yet another embodiment of the invention which can be used in connection with a garage door opening system 1100 employing a belt/chain trolley mechanism. As shown in FIG. 11A, a motor portion 1105 is connected to a rail 1110. The rail 1110 contains a belt/chain 1112 which drives a trolley (not shown) attached to the garage door. In one embodiment, rail 1110 contains a rail support 1115 around which the chain/belt 1112 revolves. In the embodiment of FIGS. 11A–11B, a magnetic reed switch 1125 is attached to the rail support 1115 and a magnet 1130 is attached to the chain/belt 1112. The magnetic reed switch 1125 may then be connected to a transmitter 1120. In one embodiment, transmitter 1120 is transmitter 120.

FIG. 11A depicts the orientation of the magnet 1130 when the garage door is in the closed position. In this position, magnetic reed switch 1125 detects the proximity of the magnet 1130 and signals the transmitter 1120 that the garage door is in the closed position.

FIG. 11B depicts an orientation of the magnet 1130 when the garage door is in a position other than fully closed. In this embodiment, magnetic reed switch 1125 detects that magnet 1130 is not in its adjacent position, therefore the garage door is not fully closed. Transmitter 1120 may then provide a signal for remote receiver 140 as described in detail above.

The invention thus provides a system and method for monitoring a panel position from a remote location. While the preceding description has been directed to particular embodiments, it is understood that those skilled in the art may conceive modifications and/or variations to the specific embodiments described herein. Any such modifications or variations which fall within the purview of this description are intended to be included herein as well. It is understood that the description herein is intended to be illustrative only and is not intended to limit the scope of the invention. Rather, the scope of the invention is to be limited only by the claims appended hereto.

What is claimed is:

1. A system for monitoring a panel comprising:

a reflective element associated with the panel;

a sensor comprised of an infrared emitter, a first infrared receiver and a second infrared receiver, each positioned along said panel, wherein said sensor is to detect a status of the reflective element and the infrared emitter is to provide a sensor signal to at least one of said first and second infrared receivers, and wherein said sensor signal is an infrared signal;

a transmitter, connected to said sensor, comprising:

a power source, a sensor signal input to receive said sensor signal, a control circuit connected to said power source and said sensor signal input, said control circuit to cause a position signal to be transmitted, said position signal corresponding to said status, and an antenna connected to said control circuit;

a remote receiver to receive said position signal and to provide a position indicator corresponding to said status.

2. The system of claim 1 wherein said reflective element is positioned to cause said infrared emitter to provide said infrared signal to the second infrared receiver when the panel is in a closed position.

3. The system of claim 2 wherein said reflective element is further positioned to cause said infrared emitter to provide said infrared signal to the first infrared receiver when the panel is not in the closed position.

4. The system of claim 3 wherein said reflective element is comprised of a plurality of reflective surfaces.

5. The system of claim 4 wherein the reflective element is comprised of two parallel reflective surfaces aligned to reflect said infrared signal.

6. The system of claim 3 wherein said transmitter receives the sensor signal from at least one of said first receiver and second receiver when the panel is not in the closed position, said transmitter to provide the position signal to the remote receiver which provides the position indicator corresponding to the status of the panel.

7. A system for monitoring a panel comprising:

a sensor to detect a status of the panel and to provide a sensor signal corresponding to said status, wherein said sensor comprises a limit switch, said limit switch to be comprised of an infrared emitter and an infrared receiver, said limit switch to detect a number of revolutions within a motor assembly using said infrared emitter and infrared receiver, said limit switch to provide said sensor signal to said transmitter when the number of revolutions equals a preset limit;

a transmitter, connected to said sensor, comprising:

a power source, a sensor signal input to receive said sensor signal, a control circuit connected to said power source and said sensor signal input, said control circuit to cause a position signal to be transmitted, said position signal corresponding to said status, and a remote receiver to receive said position signal and to provide a position indicator corresponding to said status.

8. A system for monitoring a panel comprising:

a reflective element associated with the panel;

a sensor to detect a status of the reflective element, said sensor including an infrared emitter and an infrared receiver positioned along said panel and positioned essentially perpendicular to said reflective element, where the infrared emitter is to provide a sensor signal to the infrared receiver, said sensor signal to be an infrared signal which, after contacting said reflective element, is reflected in an essentially perpendicular path back towards said infrared receiver when said panel is in a closed position;

a transmitter, connected to said sensor, comprising:

a power source, a sensor signal input to receive said sensor signal, a control circuit connected to said power source and said sensor signal input, said control circuit to cause a position signal to be transmitted, said position signal corresponding to said status, and an antenna connected to said control circuit;

a remote receiver to receive said position signal and to provide a position indicator corresponding to said status.

9. A system for monitoring a panel comprising:

a sensor to detect a status of the panel and to provide a sensor signal corresponding to said status, wherein said sensor comprises a device attached to a side of said panel, said side to contact a surface when the panel is in a closed position, said device to detect said surface when the panel is in the closed position, said sensor to provide the sensor signal to the transmitter indicating that said panel is not in the closed position when said device does not detect said surface;

a transmitter, connected to said sensor, comprising:

a power source, a sensor signal input to receive said sensor signal, a control circuit connected to said power source and said sensor signal input, said control circuit to cause a position signal to be transmitted, said position signal corresponding to said status, and an antenna connected to said control circuit;

a remote receiver to receive said position signal and to provide a position indicator corresponding to said status.

10. The system of claim 9 wherein said device is a button which is in a depressed position when the panel is in the closed position, said sensor to provide the sensor signal to the transmitter indicating that the panel is not in the closed position when said button is not in the depressed position.

11. The system of claim 9, wherein the surface is a floor and the sensor is positioned near the bottom of the panel, said panel to contact the floor when in the closed position.

12. The system of claim 9, wherein the status detected by the sensor is one of the closed position or an open position, said sensor to provide the sensor signal corresponding to the closed position when the surface is detected, said sensor to further provide the sensor signal corresponding to the open position when the surface is not detected.

13. The system of claim 9, wherein the surface is a floor that the panel contacts when in the closed position, said sensor to not detect the surface when the panel is not in contact with the floor and to provide a sensor signal indicating that the panel is in an open position.

14. The system of claim 9, wherein the sensor detects the status of the panel when a moveable portion of the sensor is displaced by the surface when the panel is in the closed position.

15. The system of claim 14, wherein said moveable portion comprises at least one of a push rod, a spring, a button, and a switch.

16. A method for monitoring a panel comprising:

positioning a reflective element on the panel;

sending a sensor signal to a transmitter where the sensor signal is provided by a sensor detecting a status of the reflective element, wherein said sensor is comprised of an infrared emitter, a first infrared receiver and a second infrared receiver, each positioned along said panel, and wherein said sensor signal is an infrared signal;

receiving said sensor signal by the transmitter;

sending a position signal from said transmitter to a remote receiver, said position signal corresponding to the status of the panel; and, providing a position indicator from said remote receiver corresponding to said status of the panel.

17. The method of claim 16 wherein positioning the reflective element on the panel further comprises positioning said reflective element on the panel to cause said infrared emitter to provide said infrared signal to the second infrared receiver when the panel is in a closed position.

18. The method of claim 17 wherein positioning the reflective element on the panel further comprises positioning said reflective element on the panel to cause said infrared emitter to provide said infrared signal to the first infrared receiver when the panel is not in the closed position.

19. The method of claim 18 wherein said reflective element is comprised of a plurality of reflective surfaces.

20. The method of claim 19 wherein said reflective element is comprised of two parallel reflective surfaces aligned to reflect said infrared signal.

21. A method for monitoring a panel comprising:

sending a sensor signal to a transmitter where the sensor signal is provided by a sensor detecting a status of a reflective element associated with the panel, said sensor comprised of an infrared emitter and an infrared receiver, where said infrared emitter and infrared receiver are positioned essentially perpendicular to said reflective element, said infrared receiver to provide a sensor signal which, after contacting said reflective element, is reflected in an essentially perpendicular path back towards said infrared receiver when the panel is in the closed position, said sensor signal to be an infrared signal;

receiving said sensor signal by the transmitter;

sending a position signal from said transmitter to a remote receiver, said position signal corresponding to the status of the panel; and, providing a position indicator from said remote receiver corresponding to said status of the panel.

22. A method for monitoring a panel comprising:

sending a sensor signal to a transmitter where the sensor signal is provided by a sensor detecting a status of the panel, said sensor to be comprised of a limit switch having an infrared emitter and an infrared receiver, said limit switch to detect a number of revolutions within a motor assembly using said infrared emitter and infrared receiver, said limit switch to provide said sensor signal to the transmitter when the number of revolutions equals a preset limit;

receiving said sensor signal by the transmitter;

sending a position signal from said transmitter to a remote receiver, said position signal corresponding to the status of the panel; and, providing a position indicator from said remote receiver corresponding to said status of the panel.

23. A method for monitoring a panel comprising:

sending a sensor signal to a transmitter where the sensor signal is provided by a sensor detecting a status of the panel, said sensor to be comprised of a device attached to a side of said panel, said side to contact a surface when the panel is in a closed position, said device to detect said surface when the panel is in the closed position, said sensor to provide the sensor signal to the transmitter indicating that said panel is not in the closed position when said device does not detect said surface;

receiving said sensor signal by the transmitter;

sending a position signal from said transmitter to a remote receiver, said position signal corresponding to the status of the panel; and, providing a position indicator from said remote receiver corresponding to said status of the panel.

24. The method of claim 23 wherein said device is a button which is in a depressed position when the panel is in the closed position, said sensor to provide the sensor signal to the transmitter indicating that the panel is not in the closed position when said button is not in the depressed position.

25. The method of claim 23, wherein sending the sensor signal to the transmitter comprises sending the sensor signal to the transmitter where the sensor signal is provided by the sensor detecting the surface when the panel is in the closed position, where said surface is a floor and the sensor is positioned near the bottom of the panel, said panel to contact the floor when in the closed position.

26. The method of claim 23, wherein sending the sensor signal to the transmitter comprises sending the sensor signal to the transmitter where the sensor signal is provided by the sensor detecting the status of the panel, where said status detected by the sensor is one of the closed position or an open position, said sensor to provide the sensor signal corresponding to the closed position when the surface is detected, said sensor to further provide the sensor signal corresponding to the open position when the surface is not detected.

27. The method of claim 24, wherein sending the sensor signal to the transmitter comprises sending the sensor signal to the transmitter where the sensor signal is provided by the sensor detecting the surface when the panel is in a closed position, wherein the surface is a floor that the panel contacts when in the closed position, said sensor to not detect the surface when the panel is not in contact with the floor and to provide a sensor signal indicating that the panel is in an open position.

28. The method of claim 23, wherein sending the sensor signal to the transmitter comprises sending the sensor signal to the transmitter where the sensor signal is provided by the sensor detecting the status of the panel when a moveable portion of the sensor is displaced by the surface when the panel is in the closed position.

29. The method of claim 28, wherein sending the sensor signal to the transmitter comprises sending the sensor signal to the transmitter where the sensor signal is provided by the sensor detecting the status of the panel when a moveable portion of the sensor is displaced by the surface when the panel is in the closed position, said moveable portion comprised of at least one of a push rod, a spring, a button, and a switch.

30. The system of claim 1, 7, 8 or 9 wherein said position indicator comprises a visual indicator.

31. The system of claim 30 wherein said visual indicator is an LED that illuminates when the panel is not in a closed position.

32. The system of claim 1, 7, 8 or 9 wherein said position indicator comprises an audio indicator.

33. The system of claim 32 wherein said audio indicator comprises a buzzer that sounds when the panel is not in a closed position.

34. The system of claim 1, 7, 8 or 9 wherein said position indicator comprises a relay to enable a power source in response to the position signal.

35. The method of claim 16, 22, 21 or 23 wherein providing a position indicator from said remote receiver comprises providing a visual indicator from said remote receiver corresponding to the status of the panel.

36. The method of claim 35 wherein said visual indicator is an LED which is illuminated when the panel is not in a closed position.

37. The method of claim 16, 22, 21 or 23 wherein providing a position indicator from said remote receiver comprises providing an audio indicator from said remote receiver corresponding to the status of the panel.

38. The method of claim 37 wherein said audio indicator is buzzer that sounds when the panel is not in a closed position.

39. The method of claim 16, 22, 21 or 23 wherein providing a position indicator from said remote receiver comprises providing a relay to enable a power source in response to the position signal.

* * * * *